United States Patent [19]

Föll et al.

[11] 4,112,307

[45] Sep. 5, 1978

[54] ELECTRON BEAM SOURCE WITH AN ELECTRON EXIT WINDOW CONNECTED VIA A WINDOW FLANGE

[75] Inventors: Eberhard Föll, Mössingen; Helmut Vetter, Tübingen, both of Fed. Rep. of Germany

[73] Assignee: Polymer-Physik GmbH & Co. KG, Fed. Rep. of Germany

[21] Appl. No.: 767,027

[22] Filed: Feb. 9, 1977

[30] Foreign Application Priority Data

Feb. 17, 1976 [DE] Fed. Rep. of Germany ..... 2606169

[51] Int. Cl.[2] ..... G21F 3/02

[52] U.S. Cl. ..... 250/510; 250/492 B; 250/503

[58] Field of Search ..... 250/396, 310, 306, 505, 250/510, 439, 443, 457, 526, 492 A, 492 B, 503; 313/34, 35, 36

[56] References Cited

U.S. PATENT DOCUMENTS 3,440,466 4/1969 Colvin et al. ..... 250/492 B 3,536,951 10/1970 Mosely ..... 250/492 B 3,742,230 6/1973 Spears ..... 250/510

*Primary Examiner*—Harold A. Dixon

*Attorney, Agent, or Firm*—McGlew and Tuttle

[57] ABSTRACT

An electron beam source with an electron exit window which is connected thereto and which essentially consists of the window frame, of a support grid, optionally provided with cooling lines, for the foil permeable to electrons and of the foil permeable to electrons. The grid is formed by one or more bridge elements each in the shape of a double comb formed by milling slots to extend inwardly from each of a pair of opposite side edges of a substantially rectangular metal plate to terminate at a main bridge element extending substantially centrally of the plate and substantially parallel to the opposite edges. The bridge elements are secured to the window frame solely by disengageable mechanical fastening elements, and no welding or brazing, either in forming the bridge elements or in securing them to the window frame, are involved.

3 Claims, 4 Drawing Figures

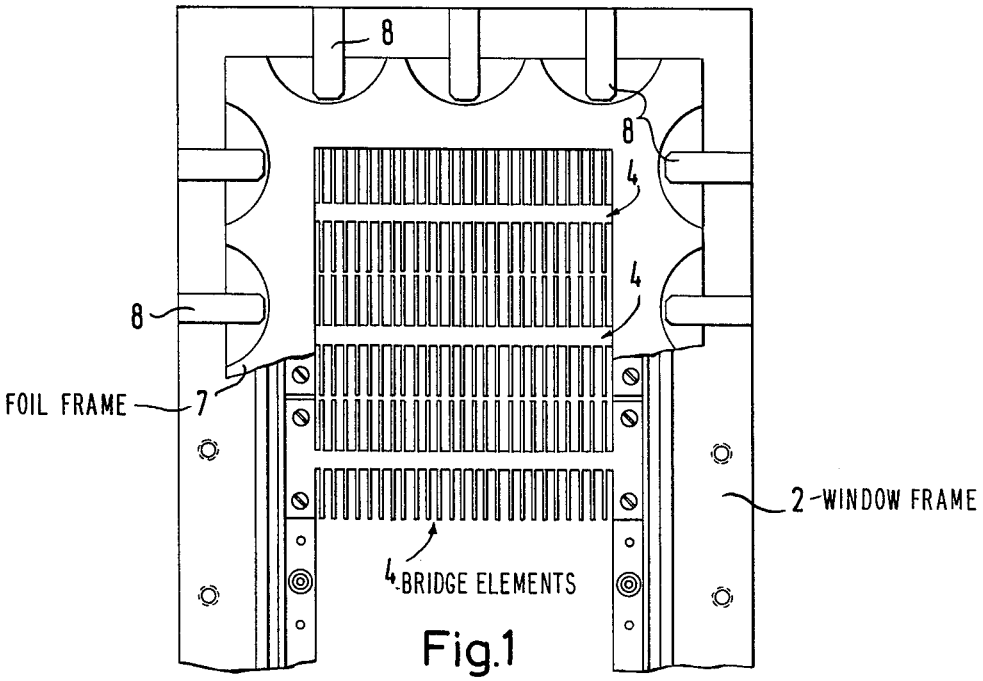
Fig.1
Fig.2
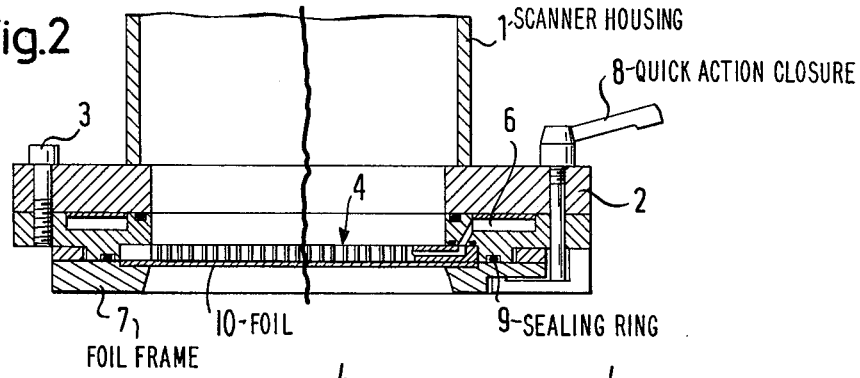
Fig.3
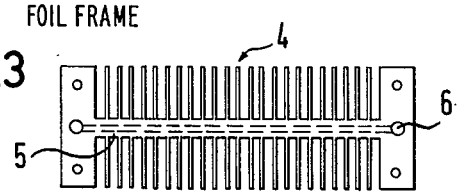
Fig.4
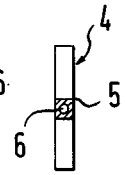

ELECTRON BEAM SOURCE WITH AN ELECTRON EXIT WINDOW CONNECTED VIA A WINDOW FLANGE

FIELD AND BACKGROUND OF THE INVENTION

The invention relates to an electron beam source with an electron exit window which is connected thereto via a window flange and which essentially consists of the window frame, of a support grid, optionally provided with cooling lines, for the foil permeable to electrons, and of the foil permeable to electrons.

Electron exit windows for electron beam sources are supported for cooling and load relief by rectangular bridges which are in good heat contact with their surroundings. When an electron beam passes through the thin metal foil of the window, which is permeable to electrons, a part of the beam power is absorbed in the metal foil and is removed from there as heat via the bridges. Moreover, the bridges serve to support the metal foil which acts as a sealing foil between the vacuum and atmospheric pressure. The foil is pressed onto the bridges of the support grid by the exterior air pressure. Support grids of this type are of particular importance in the case of electron exit windows with a large surface area, such as are used for electron beam sources with a low dose rate, for example those which operate trouble-free for hundreds of hours at accelerating voltages of 150 – 280 kV. Electron beam sources with exit windows of this type are predominatly used for irradiating thin layers for the purpose of crosslinking or for sterilising surfaces in the packaging industry.

The construction of the support grids, which is relatively involved and hence expensive to manufacture, has proved a disadvantage in all these known electron exit windows. For example, German Published Specification 1,589,773 has disclosed support grids in which the bridges are located in preformed grooves of the flange. If optimum heat transfer from the bridges to the flange is to be achieved, the bridges must be brazed into the flange, and this leads to difficulties and high costs in the industrial manufacture of the electron beam exit windows having dimensions of 130 cm and more in length and 2.5 – 10 cm in width.

Even greater difficulties arise in another embodiment described in that Specification, wherein the individual bridges are soldered to tubes through which the coolant is passed. This soldering requires such an expense that electron beam exit windows of this type cannot be manufactured economically.

Milling the bridges from a solid material also leads to difficulties. For example, in the case of bridge widths of customarily 0.5 or 1 mm, the bridges which are to be milled free are pressed away by the milling cutter towards the preceding gap already milled. Furthermore, since the milling cutter is round, the slots do not have an edge at the transition to the flange but are given the radius of a milling cutter. The circular saw blade cannot be driven completely through the slot.

As can be seen from the above statements, it is thus absolutely necessary, for the successful use of electron beam sources, to develop electron beam exit windows with support grids which can be manufactured by machine in large numbers without great expense. Furthermore, the electron beam exit windows should be constructed in such a way that, for changing the thin foil which is permeable to electrons and which represents a wearing part, it is not necessary to separate the entire window flange from the instrument, such as is still the case with the electron beam exit windows of the state of the art. Moreover, it is an object of the invention to provide support grids of a type which eliminates the necessity of changing the entire support grid - as is still customary nowadays - when individual bridges have burned through.

SUMMARY OF THE INVENTION

According to the invention, these disadvantages are avoided by using special bridge elements which can readily be manufactured on a large industrial scale (without it being necessary to machine the entire electron beam exit window). Soldering or welding at the electron beam exit window, which can also lead to strains and deformations of the entire frame, is dispensed with. Furthermore, all parts of the electron beam exit window can be manufactured from one material which has a high heat conductivity, for example aluminum, and which cannot readily be soldered and welded but can be readily machined, it being possible to machine the parts at the same time in a cost-saving manner.

The foil permeable to electrons is clamped in a separate frame and can be placed on the support grid by means of a quick-action closure without rotating the window flange.

Thus, the invention relates to an electron beam source with an electron exit window which is connected thereto via a window flange and which essentially consists of the window frame, of a support grid, optionally provided with cooling lines, for the foil permeable to electrons, and of the foil permeable to electrons, wherein the support grid is formed by one or more bridge elements in the shape of a double comb which are detachably joined to the window frame, the bridge elements in the shape of a double comb preferably being provided with tube-like bores for passing coolants therethrough. The foil permeable to electrons is clamped in a separate foil frame which is joined to the window frame by means of a quick-action closure passing through the window flange and the window frame.

Further details and features of the invention can be seen in the description which follows, in conjunction with the attached drawings. The drawings which are used to explain the invention in more detail only represent preferred embodiments. The invention itself is therefore not restricted to these preferred embodiments.

BRIEF DESCRIPTION OF THE DRAWINGS

FIG. 1 shows a plan view from below onto an electron beam exit window fitted only partially with the bridge elements according to the invention;

FIG. 2 shows a section through an electron beam exit window;

FIG. 3 shows a plan view onto a bridge element according to the invention;

FIG. 4 shows a transverse section through a bridge.

DESCRIPTION OF THE PREFERRED EMBODIMENT

The electron beam exit window which, as a rule, is rectangular, consists of a frame 2 which is fastened by means of screws 3 to the scanner housing 1. The support grid carrying the thin metal foil 10 consists of bridge elements 4 which, for the purpose of better heat removal, have through-bores in their main bridge 5 for receiving cooling water. Several of these bridge elements together can be milled at the same time, in one working step from one side and in another working step from the opposite side, using a set of miller cutters (set of circular saw blades), containing exactly the same number of saw blades as the number of slots required. The number of bridge elements depends on the working width of the electron beam device. These bridge elements are inserted into the window frame 2 and are not firmly soldered but merely joined to the frame by means of four screws. The cooling water runs through channels 6 which are sealed by means of O-rings at the transition points from the window frame to the bridge element. The fresh cooling water runs in a channel on one side of the window frame. The warmed water flows back on the other side.

Changing the foil 10 permeable to electrons is facilitated by the fact that the latter is clamped in a foil frame, 711 which is separate from the frame 2 and the support grid 4. This foil frame is pressed against the sealing ring 9 with the aid of the quick-action closures 8. This suffices for a perfect seal against the high vacuum since, once pumping has started, the external air pressure further backs up this contact pressure. Furthermore, the foil frame, 711 prevents a formation of folds in the foil 10 when the vacuum is switched on.

In practice, the bridge width, the bridge length and the distance from bridge to bridge depend on the accelerating voltages applied and on the electron current. If the accelerating voltage is low and the electron current is high, the bridges must be in a narrower arrangement since more power is lost in the metal foil and this must be removed. The width of the bridge elements 4, that is to say their dimension perpendicular to the longer side of the electron beam exit window, depends on the dose rate of the emitter required for particular fields of application.

While a specific embodiment of the invention has been shown and described in detail to illustrate the application of the principles of the invention, it will be understood that the invention may be embodied otherwise without departing from such principles.

What we claim is:

1. In an electron beam source with an electron exit window which is connected thereto, with the window comprising essentially a window frame, a support grid, and a foil, permeable to electrons, supported by the support grid, the improvement comprising, in combination, said support grid being constituted by at least one bridge element in the form of a substantially rectangular metal plate having a plurality of milled slots extending inwardly from each of a pair of opposite edges thereof and terminating at a main bridge extending substantially centrally of said plate substantially parallel to said opposite edges, whereby each bridge element has the form of a one-piece double comb formed solely by a mechanical machining of a one-piece metal plate; and disengageable mechanical fastening elements securing each bridge element to said window frame and constituting the sole means disengageably connecting each bridge element to said window frame.

2. In an electron beam source, the improvement claimed in claim 1, in which each bridge element is formed with a bore extending therethrough for circulation of a coolant therethrough.

3. In an electron beam source with an electron exit window which is connected thereto, with the window comprising essentially a window frame, a support grid, and a foil, permeable to electrons, supported by the support grid, the improvement comprising, in combination, said support grid being constituted by at least one bridge element in the form of a substantially rectangular metal plate having a plurality of milled slots extending inwardly from each of a pair of opposite edges thereof and terminating at a main bridge extending substantially centrally of said plate substantially parallel to said opposite edges, whereby each bridge element has the form of a one-piece double comb formed soley by a mechanical machining of a one-piece metal plate; disengageable mechanical fastening elements securing each bridge element to said window frame and constituting the sole means disengagably connecting each bridge element to said window frame; a separate foil frame clamping said foil, permeable to electrons, against said support grid; and quick-action closures extending through said window frame and connecting said separate foil frame to said window frame.

* * * * *